US006354266B1

(12) United States Patent
Cornell et al.

(10) Patent No.: US 6,354,266 B1
(45) Date of Patent: Mar. 12, 2002

(54) VEHICLE WITH ENGINE HAVING ENHANCED WARM-UP OPERATION MODE

(75) Inventors: Sean O. Cornell, Gridley; Richard H. Holtman, Dunlap; Scott A. Leman, Eureka; David E. Martin, Normal; Ronald D. Shinogle, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/742,716

(22) Filed: Dec. 20, 2000

(51) Int. Cl.[7] ..... F02N 17/02; F02D 13/04
(52) U.S. Cl. ..... 123/322; 123/142.5 R
(58) Field of Search ..... 123/321, 322, 123/142.5 R, 198 F, 90.15–90.18

(56) References Cited

U.S. PATENT DOCUMENTS 4,335,849 A * 6/1982 van Bashuysen .... 123/142.5 R
4,429,532 A 2/1984 Jakuba
4,700,684 A * 10/1987 Pischinger et al. ..... 12/90.16
5,056,476 A * 10/1991 King ..... 123/90.16
5,265,418 A * 11/1993 Smith ..... 123/142.5 R
5,727,510 A * 3/1998 Ban et al. ..... 123/142.5 R
5,746,175 A * 5/1998 Hu ..... 123/322

* cited by examiner

*Primary Examiner*—Erick Solis
(74) *Attorney, Agent, or Firm*—Liell & McNeil

(57) ABSTRACT

An enhanced warm-up operation mode operates a first portion of engine cylinders in a power mode and a second portion of engine cylinders in a braking mode. More fuel is injected into the powered cylinders in order to maintain engine speed and overcome the retarding force of the engine compression release brakes on the braking cylinders. The engine cycles through which cylinders are powered and which are braking during the warm-up procedure. The process reduces emissions, such as white smoke, that are common during cold start conditions.

21 Claims, 1 Drawing Sheet

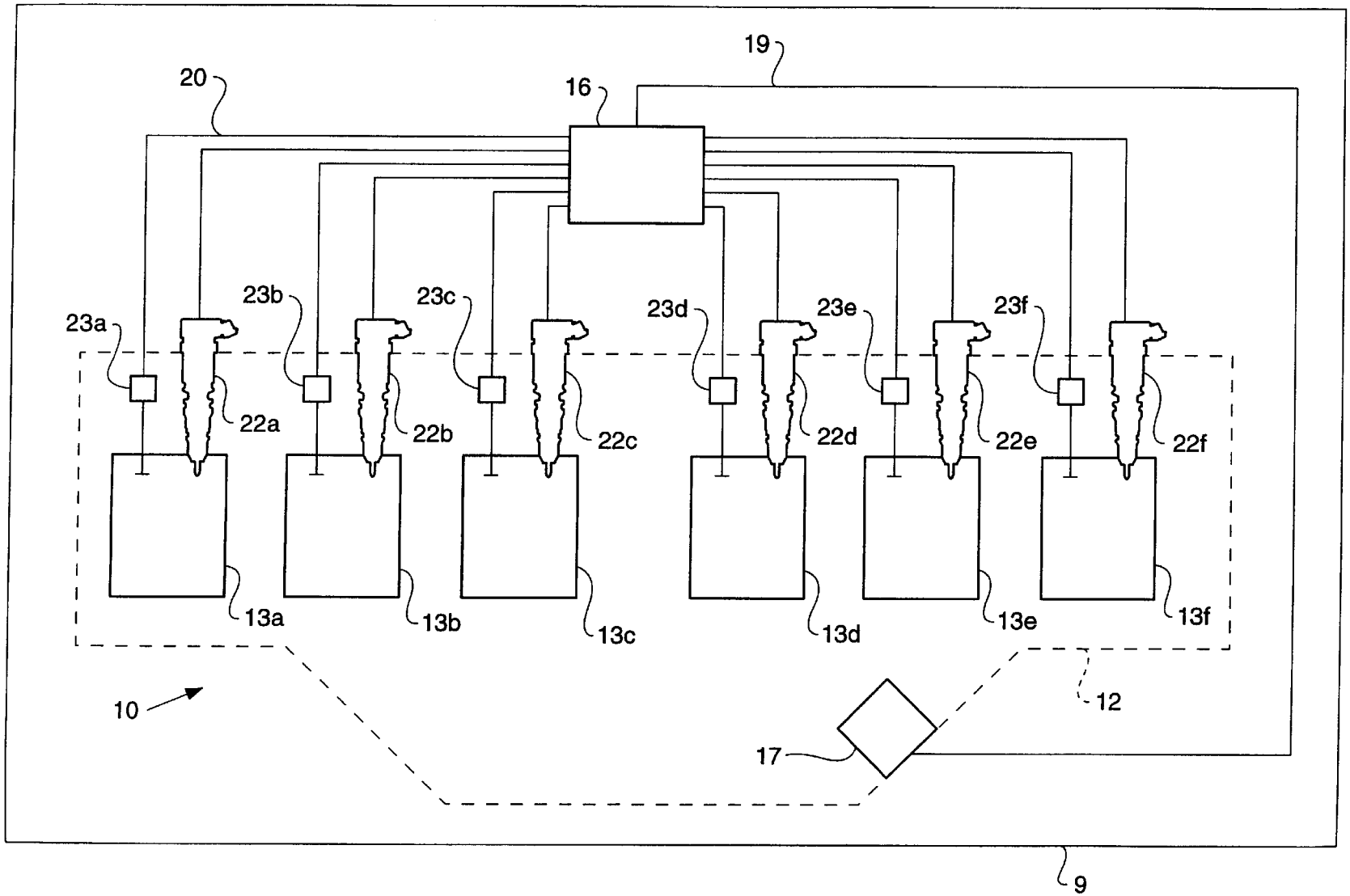
9
10
12
13a
13b
13c
13d
13e
13f
16
17
19
20
22a
22b
22c
22d
22e
22f
23a
23b
23c
23d
23e
23f

VEHICLE WITH ENGINE HAVING ENHANCED WARM-UP OPERATION MODE

TECHNICAL FIELD

This invention relates generally to vehicles with multi-cylinder engines, and more particularly to engines having an enhanced warm-up operation mode.

BACKGROUND ART

During the warm-up cycle of a traditional vehicle with a diesel engine, certain types of emissions are typically produced. One such engine emission that is commonly produced during engine warm-up is referred to as white smoke. White smoke is a vaporous mixture of unburned hydrocarbons that is believed to be produced when fuel injected into an engine cylinder condenses on the cold wall of the cylinder, remains unburned but is revaporized and eventually exhausted in the exhaust cycle of the cylinder. As a result of tougher emissions standards, engineers are constantly looking for ways reduce emissions, including white smoke, released by engine exhausts.

The present invention is directed to overcoming one or more of the problems as set forth above.

DISCLOSURE OF THE INVENTION

In one aspect of the present invention, a vehicle with an engine includes an engine housing that defines a plurality of cylinders. A plurality of electronically controlled fuel injectors are attached to the engine. A plurality of electronically controlled engine compression release brakes are also attached to the engine. An electronic control module is provided that is in control communication with each of the fuel injectors and each of the engine compression release brakes. The electronic control module includes a temperature triggered warm-up operation mode in which fuel injectors for a first portion of the cylinders and engine compression release brakes for a second portion of said cylinders are activated in each engine cycle.

In another aspect of the present invention, a method of warming up an engine with a plurality of engine cylinders includes determining an engine temperature, and if the engine temperature is below a predetermined temperature, operating a first portion, which is less than all, of said engine cylinders in a power mode during each engine cycle. A parasitic load is then applied to the engine.

In yet another aspect of the present invention, an electronic control module for an engine includes a means for commanding a first portion of engine cylinders to operate in a power mode during each engine cycle. A means for commanding a second portion of the engine cylinders to operate in a braking mode during the engine cycle is also provided.

BRIEF DESCRIPTION OF THE DRAWINGS

FIG. 1 is a schematic representation of a vehicle with an engine according to the present invention.

BEST MODE FOR CARRYING OUT THE INVENTION

Referring to FIG. 1, a vehicle 9 includes an engine 10 according to the present invention. Engine 10 provides an engine housing 12 that defines a plurality of cylinders 13. While engine housing 12 has been illustrated defining six cylinders 13*a–f*, it should be appreciated that the present invention could be used with an engine having any number of cylinders 13. As illustrated in FIG. 1, each cylinder 13*a–f* includes an electronically controlled fuel injector 22*a–f* and also preferably includes an electronically controlled engine compression release brake 23*a–f*, both of which are attached to engine housing 12. While engine 10 has been illustrated with each cylinder 13*a–f* including an engine brake 23*a–f*, it should be appreciated that engine 10 could include fewer engine brakes 23*a–f* than cylinders 13*a–f*, as in the case where only partial braking capability is required. Also provided in engine 10 is an electronic control module 17 that is in control communication with each fuel injector 22*a–f* and engine compression release brake 23*a–f* via communication lines 19, 20 and an electric current generator 16. Electronic control module 17 controls engine 10 in response to various input signals, such as engine temperature, position of the throttle and if engine 10 is in gear etc.

In addition to traditional operating modes, such as a regular operating mode, electronic control module 17 has an enhanced warm-up operation mode and a temperature maintenance mode. The enhanced warm-up mode of the present invention is preferably activated when electronic control module 17 detects that the engine temperature is below a predetermined value, the engine throttle is in the idle position, and engine 10 is not in gear. The temperature maintenance mode is preferably activated when electronic control module 17 detects that the engine temperature is below a predetermined value and engine 10 is running. Electronic control module 17 preferably measures engine temperature by detecting the temperature of engine lubricating oil or another suitable engine fluid, such as coolant fluid, circulating through engine 10. When electronic control module 17 detects the appropriate conditions, it can activate either the enhanced warm-up operation mode or the temperature maintenance mode, which will place a parasitic load on engine 10. In the case of the enhanced warm-up mode, this parasitic load will cause engine to heat up in less time than if engine 10 were simply operating in an idle operating condition. Because cylinders 13*a–f* warm up faster, the time that engine 10 produces emissions, such as white smoke emissions, can be reduced and the overall quantity of these emissions produced is reduced. Recall that white smoke is a vaporous mixture of unburned hydrocarbons that is primarily emitted by an engine during a cold start. These emissions are produced when fuel injected into a cold cylinder condenses on the cylinder wall, remains unburned and is then revaporized before being exhausted from the cylinder. In the case of the temperature maintenance mode, the parasitic load will cause engine 10 to remain in, or return to, a temperature closer to an ideal or desired engine operating temperature. For instance, when engine 10 is being operated in cold weather, the temperature maintenance mode could be employed to allow engine 10 to operate at or near an ideal or desired engine operating temperature.

Referring to the enhanced warm-up mode, the parasitic load placed on engine 10 during the enhanced warm-up operating mode is preferably created by activating some of engine compression release brakes 23*a–f* for a portion of cylinders 13*a–f*. Thus, when electronic control module 17 initiates the enhanced warm-up operation mode, it is preferable that a first portion of cylinders 13*a–f* are placed in a power mode, with respective fuel injectors 22*a–f* activated sequentially, while a second portion of cylinders 13*a–f* are placed in a braking mode, with respective engine brakes 23*a–f* activated with appropriate timing. Preferably, the first portion and the second portion are each composed of one half of cylinders 13*a–f*. Therefore, when engine 10 is operating in the enhanced warm-up mode, both the first portion and the second portion include three different cylinders 13*a–f* in the case of a six cylinder engine. However, even when the first portion and the second portion are not each made up of one half of cylinders 13*a–f*, it is preferable that the sum of the cylinders 13*a–f* in the first portion and the second portion is equal to the total number of cylinders 13*a–f*. Thus, when engine 10 is operating in the enhanced warm-up mode, each cylinder 13*a–f* preferably has either an active fuel injector 22*a–f* or an active engine brake 23*a–f*.

It is known that placing a substantial load on an engine when it is cold can cause excessive wear to engine components, such as bearings, due to the high viscosity of the cold engine lubricating oil. It should therefore be appreciated that the parasitic load placed on engine 10 should be set low enough to avoid placing too high of a load on engine 10. Those skilled in the art will appreciate that less braking horsepower can be accomplished by opening the exhaust port before the piston for an individual cylinder approaches top dead center; maximum braking horsepower is accomplished by opening the exhaust port at about top dead center. However, while the enhanced warm-up mode of the present invention has been illustrated with the parasitic load being created by activation of engine brakes 23*a–f* for a portion of cylinders 13*a–f*, it should be appreciated that an engine load could be created by other means. For instance, a parasitic load could be created by operation of a hydraulic pump that is operably coupled to engine 10 while fuel injectors 22*a–f* for less than all the cylinders 13*a–f* are firing. However, even if the parasitic load is created in this manner, it should still be set low enough to avoid placing a load on engine 10 that would be substantial enough to cause excessive wear or other undesirable effects.

Returning to engine 10, while electronic control module 17 is operating in the enhanced warm-up operation mode, the cylinders 13*a–f* that are in the first portion and the second portion preferably change after either a predetermined number of engine cycles or a predetermined time has elapsed. For example, at the beginning of the enhanced warm-up operation mode, electronic control module 17 could activate fuel injectors 22*a–c* and engine brakes 23*d–f* for the first ten engine cycles. After the tenth engine cycle, electronic control module 17 could re-evaluate the input signals to determine if operation of engine 10 in the enhanced warm-up mode is still appropriate. If so, electronic control module 17 could have actuator 16 deactivate one or more of fuel injectors 22*a–c* and engine brakes 23*d–f* and activate the corresponding engine brakes 23*a–c* and fuel injectors 22*d–f*. While the cycling of cylinders 13*a–f* from one portion to another could occur one at a time or multiple cylinders at a time, it is preferable that at least one cylinder 13*a–f* remain in the first portion each time the change occurs.

Electronic control module 17 will continue to monitor engine temperature while engine 10 is being operated in enhanced warm-up mode. Once electronic control module 17 determines that engine temperature is above a predetermined temperature, electronic control module 17 will change from the enhanced warm-up mode to a different operating mode, such as a regular operating mode. This change is preferably accomplished by reduction of the number of cylinders 13*a–f* in the braking mode to zero. The reduction of the number of cylinders 13*a–f* in the braking mode may be accomplished by two means. First, once electronic control module 17 determines that the engine temperature is above the predetermined minimum temperature, it will begin reducing the number of cylinders 13*a–f* in the braking mode until all engine brakes 23*a–f* have been deactivated. The second means provided is an automatic override to reduce the number of cylinders 13*a–f* in the braking mode. For the automatic override, movement of the engine throttle from the idle position or shifting of the engine into gear during the enhanced warm-up mode will cause electronic control module 17 to remove engine 10 from the enhanced warm-up operating mode and to place it in a different operating mode, such as a regular operating mode.

It should be appreciated that because only a portion of cylinders 13*a–f* will be in the power mode at one time during the enhanced warm-up mode, each active fuel injector 22*a–f* will need to inject substantially more fuel to maintain engine 10 at a constant speed and overcome the retarding torque produced by the engine brakes. This increase in injection could itself result in an increase in white smoke emissions produced by engine 10. Therefore, in addition to providing a means for changing which cylinders 13*a–f* are in the first portion or the second portion, the enhanced warm-up mode of electronic control module 17 also preferably provides a conventional means for adjusting at least one of the air fuel ratio, the level of exhaust gas recirculation and the injection pressure in a known manner to reduce emissions, such as white smoke emissions, from engine 10. This adjustment is preferable because sufficient adjustment of at least one of these engine characteristics can contribute to a reduction in white smoke emissions produced by the engine.

Referring again to the temperature maintenance mode, the parasitic load placed on engine 10 during this operating mode is also preferably created by activating some of engine compression release brakes 23*a–f* for a portion of cylinders 13*a–f*. Thus, it is preferable that a first portion of cylinders 13*a–f* are placed in a power mode, with respective fuel injectors 22*a–f* activated sequentially, while a second portion of cylinders 13*a–f* are placed in a braking mode, with respective engine brakes 23*a–f* activated with appropriate timing. Electronic control module 17 will continue to monitor engine temperature while engine 10 is being operated in the temperature maintenance mode. Once electronic control module 17 determines that engine temperature is above the ideal or desired engine operating temperature, electronic control module 17 can change from the temperature maintenance mode to a different operating mode, such as a regular operating mode. This change is preferably accomplished by reduction of the number of cylinders 13*a–f* in the braking mode to zero, as with the enhanced warm-up mode. In other words, electronic control module 17 will begin reducing the number of cylinders 13*a–f* in the braking mode until all engine brakes 23*a–f* have been deactivated.

INDUSTRIAL APPLICABILITY

Referring now to FIG. 1, cold starting of engine 10 initiates transmission of input signals to electronic control module 17 from various engine components. Once engine 10 achieves an idle speed, electronic control module 17 preferably measures engine temperature by detecting the temperature of engine lubricating oil or another suitable engine fluid. The actual temperature of engine 10 is then compared to the predetermined minimum temperature value stored in electronic control module 17. If the temperature of engine 10 is below the predetermined minimum value, and if the engine throttle is detected to be in an idle position and vehicle 9 is not in gear, electronic control module 17 activates the enhanced warm-up operation mode.

Once the enhanced warm-up operation mode is activated, electronic control module 17 signals actuator 16 to place a first portion of cylinders 13*a–f* in a power mode and a second portion of cylinders 13*a–f* in a braking mode while attempting to maintain a constant engine speed. Preferably, for engine 10 as illustrated in FIG. 1, actuator 16 is signaled by electronic control module 17 to activate one half of the fuel injectors 22*a–f* and one half of the engine brakes 23*a–f*, or three of each component. Engine 10 is now subjected to a parasitic load, which will cause cylinders 13*a–f* to warm up faster than if engine 10 were operating at an idle speed with all cylinders firing. Recall that because fewer than all of fuel injectors 22*a–f* are injecting fuel, these injectors will be injecting substantially more fuel during each injection cycle to maintain engine speed and overcome the parasitic load. This larger injection amount results in that cylinder warming considerably faster than if only an idle amount were injected. In addition, the compression of air in the braking cylinders also generates considerable heat that also contributes to engine warming. Depending on known concerns, such as engine wear, emission levels etc., the electronic control module will attempt to maintain the engine at some predetermined speed. This speed could be idle speed or substantially higher, or even be varied during the warm up procedure. In addition, during the enhanced warm-up mode, electronic control module 17 might alter injection pressure, air fuel ratio and/or exhaust gas recirculation in a conventional manner to prevent an increase in emissions, such as white smoke production.

After engine 10 has operated for a predetermined number of cycles, or after engine 10 has operated for a predetermined amount of time, electronic control module 17 reevaluates engine temperature to determine if it exceeds the predetermined minimum temperature. If it does, then electronic control module 17 ends the enhanced warm-up mode and begins to control engine 10 in the regular operation mode or any other appropriate operation mode. However, if the temperature of engine 10 is below the predetermined minimum temperature, and if the throttle remains in the idle position and engine 10 is not in gear, then electronic control module 17 continues to operate engine 10 in the enhanced warm-up operation mode. At this time, electronic control module 17 preferably changes which engine cylinders 13*a–f* are in the first portion and the second portion. As indicated previously, one or more cylinders 13*a–f* can be cycled between the first portion and the second portion at once. Therefore, if fuel injectors 22*a–c* and engine brakes 23*d–f* were activated during the initial segment of the enhanced warm-up mode, electronic control module 17 could deactivate fuel injectors 22*a–b* and engine brakes 23*e–f* and activate fuel injectors 22*e–f* and engine brakes 23*a–b*. The cycling between cylinders might also occur open loop in some predetermined pattern util the engine is warmed-up. Recall however, that it is preferable that at least one cylinder 13*a–f* remain in the first portion each time the change occurs.

Electronic control module 17 will continue to operate engine 10 in the enhanced warm-up mode until the engine temperature achieves the predetermined minimum temperature. When engine temperature is determined to exceed this value, electronic control module 17 will end the enhanced warm-up mode by reducing the number of cylinders 13*a–f* in the second portion to zero. Recall that electronic control module 17 also evaluates whether the engine throttle has been moved from the idle position and whether engine 10 has been shifted into gear during operation in the enhanced warm-up mode. Either of these actions will preferably be interpreted by electronic control module 17 as an automatic override, and electronic control module 17 will take engine 10 out of enhanced warm-up mode and begin operating it in another operating mode, such as a regular operating mode or the temperature maintenance mode.

In addition to operation of engine 10 in the enhanced warm-up mode, engine 10 can also be operated in a temperature maintenance mode while engine 10 is in running to allow engine 10 to operate at temperatures closer to an ideal or desired operating temperature. Therefore, while engine 10 is operating, if electronic control module 10 detects that engine temperature has fallen below a desired level, electronic control module 17 can activate the temperature maintenance mode. Once the temperature maintenance mode is activated, electronic control module 17 signals actuator 16 to place a first portion of cylinders 13*a–f* in a power mode and a second portion of cylinders 13*a–f* in a braking mode. After engine 10 has operated for a predetermined number of cycles, or after engine 10 has operated for a predetermined amount of time, electronic control module 17 reevaluates engine temperature to determine if it exceeds the desired operating temperature. If it does, then electronic control module 17 ends the temperature maintenance mode and begins to control engine 10 in the regular operation mode or any other appropriate operation mode. However, if the temperature of engine 10 is below the desired operating temperature, then electronic control module 17 continues to operate engine 10 in the temperature maintenance mode. It should be appreciated that, in instances such as when engine 10 is operating in cold weather, it might be preferable to operate engine 10 in the temperature maintenance mode for a majority of the duration of operation of engine 10.

It should be appreciated that use of the present invention can provide a number of benefits to traditional engines. For instance, because a parasitic load is being applied while attempting to maintain engine speed, engine 10 will warm up from cold start faster than a traditional engine. Further, because the cylinders are being warmed up faster, the total amount of emissions, such as white smoke, produced while warming up can be reduced.

It should be understood that the above description is intended for illustrative purposes only, and is not intended to limit the scope of the present invention in any way. For instance, while the present invention has been illustrated using a parasitic load that is created by activation of a number of the engine brakes, it should be appreciated that other parasitic loads, such as those created by a hydraulic pump operably coupled to the engine, could instead be substituted. Further, while the present invention has been illustrated with the engine being operated at an idle speed, it should be appreciated that it could instead be operated at a higher, but less than rated, speed during operation in the enhanced warm-up mode. Thus, those skilled in the art will appreciate that other aspects, objects and advantages of this invention can be obtained from a study of the drawings, the disclosure and the appended claims.

What is claimed is:

1. A vehicle comprising:

a vehicle with an engine defining a plurality of cylinders;

a plurality of electronically controlled fuel injectors attached to said engine;

a plurality of electronically controlled engine compression release brakes attached to said engine;

an electronic control module in control communication with each of said fuel injectors and each of said engine compression release brakes; and said electronic control module including a temperature triggered warm-up operation mode in which fuel injectors for a first portion of said cylinders and engine compression release brakes for a second portion of said cylinders are activated in each engine cycle.

2. The vehicle of claim 1 wherein said first portion of said cylinders plus said second portion of said cylinders equals said plurality of cylinders.

3. The vehicle of claim 2 wherein each of said cylinders has one of said fuel injectors and one of said engine compression release brakes.

4. The vehicle of claim 1 wherein less than all of said cylinders has one of said engine compression release brakes.

5. The vehicle of claim 1 wherein said warm-up operation mode changes which of said cylinders are included in said first portion and which of said cylinders are included in said second portion.

6. The vehicle of claim 5 wherein said warm-up operation mode changes which cylinders are in said first portion and said second portion after at least one of a predetermined number of engine cycles and a predetermined time.

7. The vehicle of claim 6 wherein each of said first portion and said second portion is half of said cylinders.

8. The vehicle of claim 6 wherein at least one of said cylinders remains in said first portion each time said warm-up operation mode changes which cylinders are in said first portion and said second portion.

9. The vehicle of claim 1 wherein said electronic control module changes from said warm-up operation mode to a different operation mode when said engine reaches a predetermined temperature.

10. The vehicle of claim 1 wherein said warm-up operation mode includes an adjustment in at least one of air fuel ratio, level of exhaust gas recirculation and injection pressure that is sufficient to reduce white smoke emissions from said engine.

11. The vehicle of claim 1 wherein said electronic control module includes a temperature maintenance operation mode in which at least one of said cylinders is operating in a power mode and at least one other of said cylinders is operating in a braking mode in each engine cycle.

12. A method of warming up an engine with a plurality of engine cylinders, comprising the steps of:

determining an engine temperature;

if said engine temperature is below a predetermined temperature operating a first portion, which is less than all, of said engine cylinders in a power mode during each engine cycle; and applying a parasitic load to the engine.

13. The method of claim 12 wherein said step of applying a parasitic load includes a step of operating a portion of said engine cylinders in a braking mode during said engine cycle.

14. The method of claim 13 including a step of changing which of said engine cylinders are in said first portion and which are in said second portion.

15. The method of claim 13 including a step of keeping at least one cylinder in said first portion each time said changing step is performed.

16. The method of claim 12 including a step of reducing white smoke emissions by adjusting at least one of air fuel ratio, level of exhaust gas recirculation and injection pressure.

17. The method of claim 12 including the step of reducing said second portion to zero when said engine temperature reaches said predetermined temperature.

18. An electronic control module for an engine comprising:

means for determining an engine's temperature;

means for commanding a first portion of engine cylinders to operate in a power mode during each engine cycle if said engine temperature is below a predetermined temperature; and means for commanding a second portion of said engine cylinders to operate in a braking mode during said engine cycle if said temperature is below a predetermined temperature.

19. The electronic control module of claim 18 including means for commanding an adjustment of at least one of air fuel ratio, level of exhaust gas recirculation and injection pressure.

20. The electronic control module of claim 18 including means for changing which cylinders are in said first portion and which are said second portion.

21. The electronic control module of claim 18 including means for reducing said second portion to zero in response to a predetermined input.

* * * * *